US007152505B2

(12) United States Patent
Chan et al.

(10) Patent No.: US 7,152,505 B2
(45) Date of Patent: Dec. 26, 2006

(54) BOTTLE CAP TURNING DEVICE

(76) Inventors: Yung C. Chan, 2938 Old Baltimore Rd., Draper, VA (US) 24324; Mei H. Chan, 2938 Old Baltimore Rd., Draper, VA (US) 24324; King H. Chan, 2938 Old Baltimore Rd., Draper, VA (US) 24324; Ming H. Chan, 2938 Old Baltimore Rd., Draper, VA (US) 24324

( * ) Notice: Subject to any disclaimer, the term of this patent is extended or adjusted under 35 U.S.C. 154(b) by 58 days.

(21) Appl. No.: 11/113,233

(22) Filed: Apr. 25, 2005

(65) Prior Publication Data

US 2006/0236814 A1 Oct. 26, 2006

(51) Int. Cl.

| | |
|---|---|
| ***B67B 7/14*** | (2006.01) |
| ***B67B 7/18*** | (2006.01) |
| ***B67B 7/00*** | (2006.01) |
| ***B67B 7/92*** | (2006.01) |

(52) U.S. Cl. ..... 81/3.4; 81/3.44; 81/3.43; 81/3.07

(58) Field of Classification Search ..... 81/3.4, 81/3.42, 3.44, 3.41, 3.43, 3.09, 3.07, 342, 81/343, 64; 269/3, 6; D8/33–43
See application file for complete search history.

(56) References Cited

U.S. PATENT DOCUMENTS

| | | | | |
|---|---|---|---|---|
| 1,593,947 | A * | 7/1926 | Miller et al. | 81/3.42 |
| D357,619 | S * | 4/1995 | Osmar et al. | D8/34 |
| D430,467 | S * | 9/2000 | Kauppi | D8/33 |

* cited by examiner

*Primary Examiner*—Lee D. Wilson
*Assistant Examiner*—Bryan R. Muller
(74) *Attorney, Agent, or Firm*—William L. Klima; Klima Law Offices, PLLC

(57) ABSTRACT

A bottle cap turning device for untightening or tightening a bottle cap during an opening operation or closing operation, respectively. The bottle cap turning device preferably progressively engages and further grips the bottle cap when the bottle cap turning device is twisted until the bottle cap begins to rotate during the opening operation or until the bottle cap stops rotating and is fully tightened on the bottle.

16 Claims, 3 Drawing Sheets

BOTTLE CAP TURNING DEVICE

FIELD OF THE INVENTION

The present invention is directed to a bottle cap turning device for untightening or tightening (i.e. opening and closing) a bottle cap on a bottle, for example a soda or water bottle.

BACKGROUND OF THE INVENTION

Currently, there exist many cumbersome and difficult to use gadgets for opening bottles and jars. Most of these gadgets are difficult or impossible to use by persons having severe arthritis.

There exists a need for a simple, inexpensive and easy to use device for persons having severe arthritis to untighten or tighten, or otherwise open or close a bottle cap on a bottle. The present invention provides a bottle cap turning device having these attributes.

SUMMARY OF THE INVENTION

A first object of the present invention is to provide an improved bottle cap turning device.

A second object of the present invention is to provide an improved bottle cap and bottle opening and closing device.

A third object of the present invention is to provide a bottle cap turning device having a single piece construction.

A fourth object of the present invention is to provide a bottle cap turning device molded as a single resilient unit.

A fifth object of the present invention is to provide a bottle cap turning device made of resilient plastic or rubber material.

A sixth object of the present invention is to provide a triangular-shaped bottle cap turning device.

A seventh object of the present invention is to provide a right triangle-shaped bottle cap turning device.

A eighth object of the present invention is to provide a bottle cap turning device having a triangular-shaped finger-gripping member having a bottle cap receiver.

A ninth object of the present invention is to provide a bottle cap turning device including a right-triangular-shaped finger-gripping member provided with a bottle cap receiver.

A tenth object of the present invention is to provide a bottle cap turning device including a bottle cap receiver configured for gripping a bottle cap, and further or progressively gripping the bottle cap as the device is twisted.

A eleventh object of the present invention is to provide a bottle cap turning device including a bottle cap receiver configured to tighten on the bottle cap as the device is twisted.

A twelfth object of the present invention is to provide a bottle cap turning device for untightening or tightening a bottle cap on a bottle, the device including a resilient right triangular-shaped finger gripping member having an upper right triangular-shaped side and a lower right triangular-shaped side; a resilient circular-shaped bottle cap receiver provided in the finger gripping member, the bottle cap receiver reducing in diameter to grip an outer surface of the bottle cap upon exerting a gripping force by fingers of a user on an outer surface of the finger gripping member; three (3) resilient blade-shaped slots provided in the finger gripping member, the three (3) slots defining three (3) spokes ending and defining the bottle cap receiver, the three (3) slots opening into said bottle cap receiver and extending substantially tangentially outwardly from the circular-shaped bottle cap receiver towards respective corners of the triangular-shaped finger gripping member, the slots being located equidistance around a perimeter of the circular-shaped bottle cap receiver, two of the slots being longer than the third slot, the blade-shaped slots being wider at their inner bases and tapering downwardly towards their outer ends; and three (3) sets of gripping teeth provided on three (3) inner surface portions of the bottle cap receiver and located between adjacent slots, the gripping teeth being aligned parallel and spaced apart to mesh and cooperate with outer ridges provided on an outer surface of a bottle cap to be opened, whereby the gripping teeth initially engage the outer ridges of the bottle cap and then increasingly forcibly grip the bottle cap as said finger gripping member is further twisted by the user until the bottle cap begins to turn relative to the bottle.

A thirteenth object of the present invention is to provide a bottle cap turning device for untightening or tightening a bottle cap on a bottle, the device including a resilient triangular-shaped finger gripping member having an upper triangular-shaped side and a lower triangular-shaped side; a resilient circular-shaped bottle cap receiver provided in the finger gripping member, the bottle cap receiver reducing in diameter to grip an outer surface of the bottle cap upon exerting a gripping force by fingers of a user on an outer surface of the finger gripping member and twisting the device; three (3) resilient slots provided in the finger gripping member, the three (3) slots opening into the bottle cap receiver and extending substantially tangentially outwardly from the circular-shaped bottle cap receiver towards respective corners of the triangular-shaped finger gripping member, the slots being located equidistance around a perimeter of the circular-shaped bottle cap receiver; and three (3) sets of bottle cap gripping members provided on three (3) inner surface portions of the bottle cap receiver and located between adjacent slots, the bottle cap gripping members progressively cooperating with an outer surface of the bottle cap as the bottle cap is being untightened or tightened while the bottle cap resists turning, whereby the bottle cap gripping members initially engage the outer ridges of the bottle cap and then increasingly engage and forcibly grip the bottle cap as the finger gripping member is further twisted by the user until the bottle cap begins to turn relative to the bottle.

A fourteenth object of the present invention is to provide a bottle cap turning device wherein the bottle cap receiver opens on both triangular-shaped sides of the finger gripping member, and one side of the device is configured to untighten the bottle cap on the bottle, and the opposite side of the device is configured to tighten the bottle cap on the bottle.

A fifteenth object of the present invention is to provide a bottle cap turning device wherein the three (3) slots are oriented substantially parallel relative to three (3) sides of the finger gripping member.

A sixteenth object of the present invention is to provide a bottle cap turning device wherein the three (3) resilient slots decrease in width as the finger gripping member is twisted, and gripping force is applied by the bottle cap gripping members onto the bottle cap receiver.

A seventeenth object of the present invention is to provide a bottle cap turning device wherein the three (3) slots are blade-shaped slots A eighteenth object of the present invention is to provide a bottle cap turning device wherein the three (3) slots each have curvilinear sides.

A nineteenth object of the present invention is to provide a bottle cap turning device wherein outer sides of the three (3) slots are concave-shaped.

A twentieth object of the present invention is to provide a bottle cap turning device wherein inner sides of the three (3) slots are convex-shaped.

A twenty first object of the present invention is to provide a bottle cap turning device wherein inner sides of the three (3) slots are convex-shaped.

A twenty second object of the present invention is to provide a bottle cap turning device wherein the triangular-shaped finger gripping member is a right triangular-shaped finger gripping member.

A twenty third object of the present invention is to provide a bottle cap turning device wherein the three (3) bottle cap gripping members are three (3) sets of gripping teeth.

A twenty fourth object of the present invention is to provide a bottle cap turning device wherein the gripping ridges are spaced apart and oriented parallel with ridges located on the outer surface of the bottle cap to mesh and cooperate therewith during untightening and tightening of the bottle cap on the bottle.

A twenty fifth object of the present invention is to provide a bottle cap turning device wherein an inner diameter of the circular-shaped receiver when unstressed is greater than an outer diameter of the bottle cap.

A twenty sixth object of the present invention is to provide a bottle cap turning device wherein an inner diameter of the circular-shaped receiver when unstressed is equal to an outer diameter of the bottle cap.

A twenty seventh object of the present invention is to provide a bottle cap turning device wherein an inner diameter of the circular-shaped receiver when unstressed is less than an outer diameter of the bottle cap.

A twenty eighth object of the present invention is to provide a bottle cap turning device wherein the three (3) gripping members are three (3) sets of teeth.

A twenty ninth object of the present invention is to provide a bottle cap turning device wherein the sets of teeth progressively engage and grip the outer ridges on the bottle cap as the finger gripping member is twisted.

A thirtieth object of the present invention is to provide a bottle cap turning device wherein the sets of teeth are oriented to progressively engage and grip the outer ridges on the bottle cap as the finger gripping member is twisted.

A thirtieth first object of the present invention is to provide a bottle cap turning device wherein the sets of teeth are progressively oriented along a curved segment set off angle relative to a curvature of the outer surface of the bottle cap.

The present invention is directed to a bottle cap turning device. Specifically, the present invention is directed to a bottle cap turning device for untightening or tightening (i.e. opening or closing) a bottle cap on a bottle.

The bottle cap turning device according to the present invention is preferably a single piece unit made of resilient material such as plastic or rubber. However, a bottle cap turning device according to the present invention can be made of multiple separate pieces and assembled together. For example, a tougher plastic material (e.g. nylon), bottle gripping members can be insert molded into a more resilient plastic injection molded material to increase the wear resistance of the bottle cap gripping members while retaining the resilience of the finger gripping member.

The present invention is preferably a triangular-shaped bottle cap turning device, more preferably a right triangular-shaped bottle cap turning device. The right triangular-shaped bottle cap turning device is more user friendly for persons having severe arthritis by allowing for a more open type of grip using less finger movement and finger pressure, and more palm force by the user. This reduces pain in the finger joints during use.

A preferred embodiment of the bottle cap turning device according to the present invention includes a triangular-shaped finger gripping member having an upper triangular-shaped side and a matching lower triangular-shaped side. The finger gripping member is provided with a bottle cap receiver therein. For example, the bottle cap receiver can be accessible from only one side of the bottle cap turning device, but more preferably is open and accessible from both the upper side and lower side of the bottle cap turning device. More preferably, the bottle cap receiver is through hole throughout the thickness of the bottle cap turning device. In a more preferred embodiment, the bottle cap receiver is a circular-shaped bottle cap receiver.

The inner diameter of the bottle cap receiver can be greater, the same, or less than the outer diameter of the bottle cap to be turned. Preferably, the inner diameter of the bottle cap receiver is close in diameter to the outer diameter of the bottle cap to be turned so that the bottle cap turning device can initially be placed over the bottle cap on the bottle, and then self grips the bottle cap. In this manner, the user can place the bottle cap turning device on a bottle cap to be turned, and the bottle cap turning device will then stay in place or position on the bottle cap without being further held there by the user. Once the bottle cap turning device is placed over the bottle cap to be turned, in a next step, the user can then concentrate on twisting the bottle cap turning device without further steadying or stabilizing the bottle cap turning device on the bottle cap.

The finger gripping member is provided with at least one slot, preferably three (3) slots extending from the bottle cap receiver towards the corners of the triangular-shaped finger gripping member. In a preferred embodiment, the bases of the slots adjacent to the bottle cap receiver are wider versus the outer ends of the slots. Further, the slots are preferably blade-shaped slots. For example, the side of the slots are curvilinear. In a preferred embodiment, the outer edges of the slots are concave-shaped and the inner edges of the slots are covex-shaped. Further, in a preferred embodiment having a right triangular-shaped finger gripping member two (2) of the slots are longer than the third slot, or otherwise the bottle cap receiver is placed off center and then all three (3) slots can be the same length.

The slots in the finger gripping member preferably extend tangentially or substantially tangentially from the bottle cap receiver, and are oriented substantially parallel to the sides of the finger gripping member. During use, the width of the slots decreases causing the inner portion of the finger gripping member located around the bottle cap receiver to extend inwardly and curl or wrap around an outer surface of the bottle cap as the finger gripping member is twisted and the bottle cap resists turning. Thus, the slots allow the inner portion of the finger gripping member located around the bottle cap receiver (i.e. bottle cap gripping members) to resiliently rotate relative to the outer portion or sides of the finger gripping member.

In a preferred embodiment, the slots in the finger gripping member define one or more spokes extending from an outer portion of the finger gripping member to the bottle cap receiver. The ends of the spokes define the bottle cap receiver, and also define the bottle cap gripping members for contacting with and gripping the outer surface of the bottle cap during attempted turning of the bottle cap relative to the bottle while the bottle cap resists turning.

In a preferred embodiment, the bottle cap receiver provided in the finger gripping member includes one or more bottle cap gripping members. In a most preferred embodiment, the bottle cap gripping members are provided with a plurality of teeth or sets of teeth. The teeth are preferably spaced apart and oriented to engage with and mesh closely or exactly with the ridges provided on the outer surface of the bottle cap to be turned. For example, the teeth on the bottle cap gripping members can be sets of rack-type gear teeth located on a curved segment that match in shape and spacing with the ridges on the outer surface of the bottle cap to be turned.

The bottle cap turning device according to the present invention is preferably configured to progressively engage and/or further grip the bottle cap as the bottle cap turning device is twisted and the bottle cap resists turning. For example, the bottle cap gripping members can be configured or designed to further engage (e.g. engage over a greater surface area or increase gripping pressure or turning movement) with the outer surface of the bottle cap as the bottle cap turning device is twisted. Alternatively, more-and-more teeth of the bottle cap gripping members can engage with more-and-more ridges on the outer surface of the bottle cap to be turned as the bottle cap is twisted against the resistance of the bottle cap from turning. In another example, the sets of teeth are set at a tangential angle slightly different from that of the surface of the bottle cap so that more and more individual teeth of the sets of teeth mesh with more-and-more outer ridges on the bottle cap as the bottle cap turning device is twisted and the bottle cap resists turning or rotating. The elastic nature of the material used to make the bottle cap turning device creates a greater-and-greater resilient and rotational spring force or turning moment on the bottle cap receiver and bottle cap as the bottle cap turning device is twisted by the fingers of the user against the turning resistance of the bottle cap until enough force or turning moment is exerted on the bottle cap begin to rotate same. This turning process can be used for untightening and tightening the bottle cap on the bottle.

The bottle cap turning device according to the present invention is preferably mold of plastic resin or rubber composition, or more preferably injection molded with plastic or rubber-like resin or composition in an injection molding machine. In this manner, the entire bottle cap turning device is molded, and then drops out of the molding machine ready to be used.

DETAILED DESCRIPTION OR PREFERRED EMBODIMENTS

Figure 1:
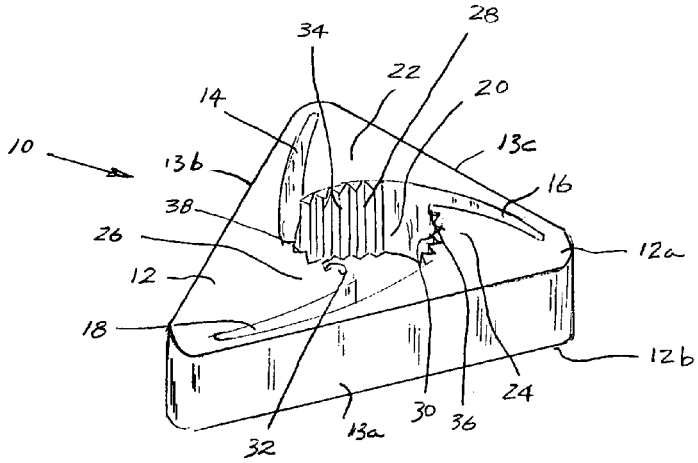
FIG. 1 is a perspective view of a preferred embodiment of the bottle cap turning device according to the present invention.

A preferred embodiment of the bottle cap turning device 10 according to the present invention is shown in FIGS. 1–4.

The bottle cap turning device 10 includes a right triangular-shaped finger-gripping member 12 having three (3) slots 14, 16, 18 extending substantially tangentially from a bottle cap receiver 20. The bottle cap receiver 20 is a circular-shaped bottle cap receiver 20. The slots 14, 16, 18 and bottle cap receiver 20 extend through the thickness of the bottle cap turning device 10 from the upper side 12*a* to the lower side 12*b* of the finger gripping member 12.

The slots 14, 16, 18 define spoke members 22, 24, 26 provided with gripping members 28, 30, 32, respectively at the inner ends thereof. The bottle cap gripping members 28, 30, 32 are each provided with sets of ridges or teeth 34, 36, 38 respectively.

Figure 2:
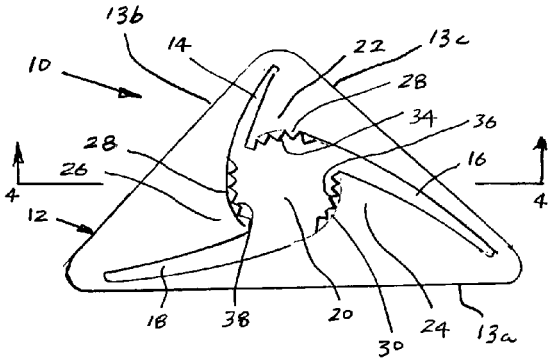
FIG. 2 is a top planar view of the bottle cap turning device shown in FIG. 1.
Figure 3:
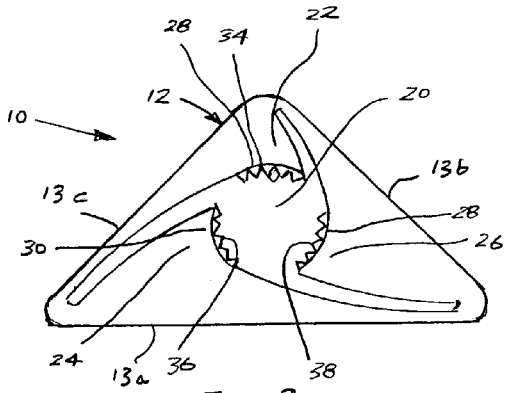
FIG. 3 is a bottom planar view of the bottle cap turning device shown in FIG. 1.
Figure 4:
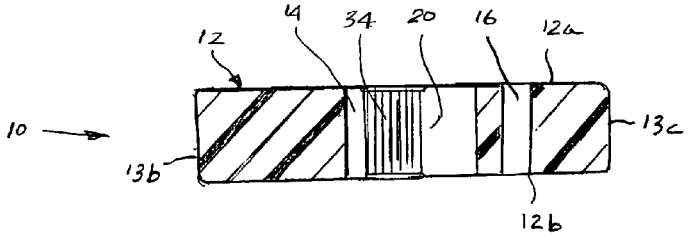
FIG. 4 is a cross-sectional view of the bottle cap turning device as indicated in FIG. 2.

The bottle cap turning device 10 is configured to untighten a bottle cap 100 to be removed when in an upright position, as shown in FIG. 2. The bottle cap turning device 10 is configured to tighten a bottle cap 100 when turned upside down as shown in FIG. 3. In this manner, the bottle cap turning device 10 can be used for untightening and tightening a bottle cap 100. In some embodiments, the bottle cap receiver 20 does not extend all the way through the thickness of the finger gripping member 12, and such an embodiment can be used to only untighten or tighten a bottle cap depending on its configuration. For example, the upper triangular-shaped side 12*a* can be solid, and the bottle cap receiver 20 can only be accessible from the bottom triangular-shaped side 12*b*.

Figure 5:
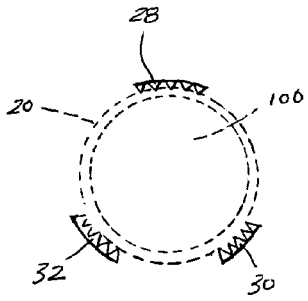
FIG. 5 is a top diagrammatic view of the bottle cap receiver of a bottle cap turning device having an inner diameter greater than an outer diameter of the bottle cap.
Figure 6:
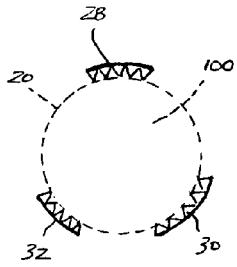
FIG. 6 is a top diagrammatic view of the bottle cap receiver of a bottle cap turning device having an inner diameter the same or equal to an outer diameter of the bottle cap.
Figure 7:
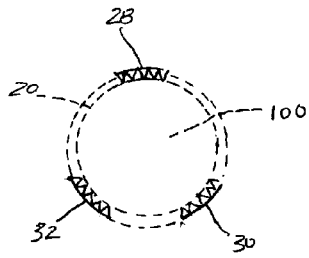
FIG. 7 is a top diagrammatic view of the bottle cap receiver of a bottle cap turning device having an inner diameter less than an outer diameter of the bottle cap.

The inner diameter of the bottle cap receiver 20 can be greater, equal, or less than the outer diameter of a bottle cap 100 to be removed, as shown in FIGS. 5–7.

Preferably, the inner diameter of the bottle cap receiver 20 is the same or almost the same as the outer diameter of the bottle cap to be removed so that when the bottle cap turning device 10 is fitted over a bottle cap to be turned, the bottle cap turning device 10 remains somewhat connected and stabilized on the bottle 102 even if the user releases his or her finger grip on the bottle cap turning device 10. In this manner, the user does not need to hold or stabilize the bottle cap turning device 10 once placed on the bottle 102 during the twisting operation of the bottle cap turning device 10 to untighten or tighten the bottle cap 100. Thus, the person can concentrate on only the twisting aspect after the bottle cap turning device 10 has been connected to the bottle cap 100 on the bottle 102 (See FIG. 15). More preferably, the inner diameter of the bottle cap receiver 20 is slightly less than the outer diameter of the bottle cap 100 to be removed so that the bottle cap turning device 10 securely fits or connects with the bottle cap 100 when placed or positioned thereon.

FIG. 5 shows the bottle cap 100 to be turned having an outer diameter slightly less than the inner diameter of the bottle cap receiver 20. FIG. 6 shows the inner diameter of the bottle cap receiver 20 to be the same or equal to the outer diameter of the bottle cap 100 to be turned. FIG. 7 shows the inner diameter of the bottle cap receiver 20 to be less than the outer diameter of the bottle cap 100 to be turned.

Figure 8:
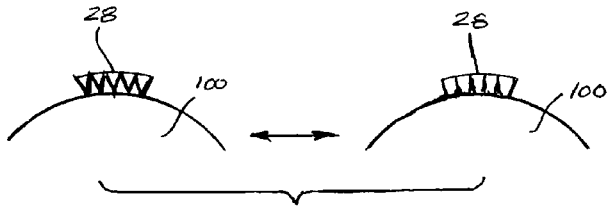
FIG. 8 is a diagrammatic view of a set of same size teeth of the bottle cap receiver engaging an outer surface of the bottle cap, and then further engaging the outer surface of the bottle cap when placed in a stressed condition when twisting the device against the resistance of the bottle cap turning.
Figure 9:
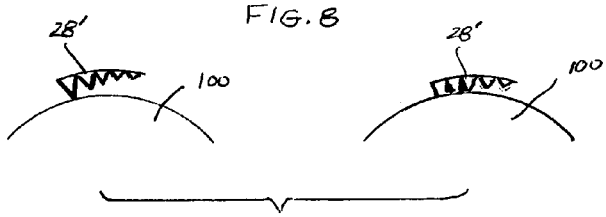
FIG. 9 is a diagrammatic view of a set of progressively decreasing size teeth of the bottle cap receiver engaging an outer surface of the bottle cap, and then further engaging the outer surface of the bottle cap when placed in a stressed condition when twisting the device against the resistance of the bottle cap turning.
Figure 10:
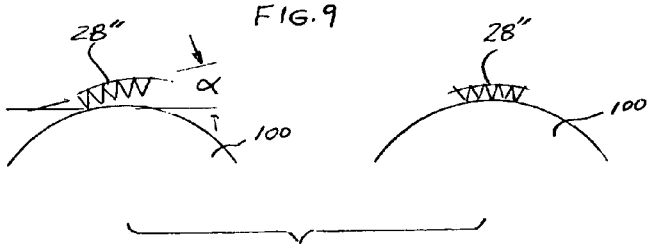
FIG. 10 is a diagrammatic view of a set of same size teeth of the bottle cap receiver set off angle to a tangent of the curvature of the bottle cap and engaging an outer surface of the bottle cap, and further engaging the outer surface of the bottle cap when placed in a stressed condition when twisting the device against the resistance of the bottle cap turning.

The bottle cap turning device 10 is preferably designed or configured so as to progressively grip the bottle cap 100 during a twisting or turning operation of the bottle cap to untighten or tighten the bottle cap 100 on the bottle 102. As shown in the embodiment of FIG. 8, the sets of teeth 34, 36, 38 initially engage, and then begin to compress as the bottle cap turning device 10 is twisted while the bottle cap 100 resists rotation. Thus, more-and-more force or moment is exerted on the outer surface of the bottle cap 100 as the bottle cap turning device 10 is further twisted while the bottle cap 100 resists rotation. As some point, enough force or moment is exerted on the bottle cap by the bottle cap turning device 10 to cause the bottle cap 100 to begin to rotate. In the embodiment shown in FIG. 9, the sets of teeth 28' progressively increase in the size so that only the larger left side teeth initially engage the outer surface of the bottle cap, and then more-and-more teeth engage, as the bottle cap turning device 10 is further twisted while the bottle cap 100 resists rotating. In the embodiment shown in FIG. 10, the set of same size teeth 28" are located along a curved segment and set at a slight angle $\alpha$ relative to the tangent of the outer surface curvature of the bottle cap 100 so that only a few teeth initially engage with the outer surface of the bottle cap 100, and then more-and-more teeth engage as the bottle cap turning device 10 is twisted while the bottle cap 100 resists rotation. In this manner, the bottle cap turning device 10 can be configured to progressively engage and exert more-and-more force or moment on the bottle cap 100 until the bottle cap 100 begins to rotate.

The slots 14, 16, 18 are configured to resiliently compress or decrease in width as the bottle cap turning device 10 is twisted while the bottle cap 100 resists rotation. The tangential or substantially tangential orientation of the slots 14, 16, 18 relative to the bottle cap receiver 20 allows the angle of the slots 14, 16, 18 to slightly change relative to the outer circumference of the bottle cap receiver 20 so as to cause the slots 14, 16, 18 to begin to curl or wrap around the bottle cap receiver 20 tightening the grip on the bottle cap 100. Again, this provides a progressive engagement and grip of the bottle cap turning device 10 with the bottle cap 100 as the bottle cap turning device 10 is further twisted and the bottle cap 100 resists rotation. If the bottle cap 100 continues to resist rotation, the slots 14, 16, 18 further compress to the point where the outer surfaces 14*a*, 16*a*, 18*a* of the slots 14, 16, 18 engage with the inner surfaces 14*b*, 16*b*, 18*b* of the slots 14, 16, 18, at which point the gripping force onto the bottle cap 100 significantly increases due to the actual engagement of these surfaces (i.e. direct force transmittance). Specifically, when the slots 14, 16, 18 are fully compressed, then the full resilience of the material comprising the bottle cap turning device 10 takes effect greatly increasing the tightening force on the outer surface of the bottle cap 100 due to the removal of the spring effect provided by the resilient slots 14, 16, 18 verses when in an opened condition.

Figure 11:
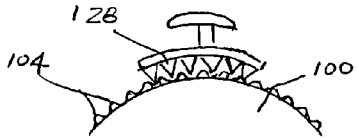
FIG. 11 is a diagrammatic view of a set of same size teeth of the bottle cap receiver engaging an outer surface of the bottle cap.

In the embodiment shown in FIG. 11, the bottle cap gripping members 28, 30, 32 of the embodiment shown in FIG. 1 are replaced with separate bottle cap gripping members 128 (shown), 130 and 132 (not shown) made of a different material (e.g. harder plastic material versus surrounding plastic material of finger gripping element 12). The separate bottle cap gripping members 128, 130, 132, for example, can be insert injection molded while molding the bottle cap turning device. For example, the separate bottle cap gripping members 128, 130, 132 can be made of nylon or a more wear-proof resin material to increase the wear life or gripping ability of the bottle cap gripping members 128, 130, 132 versus that of the surrounding finger grip member material. For example the gripping member 128 is provided with a barb 129, which becomes anchored to the surrounding finger gripping member when insert injection molding. In FIG. 11, the size and spacing of the teeth 128 match the size and spacing of the ridges 104 on the bottle cap 100 to properly mesh therewith.

Operation

Figure 15:
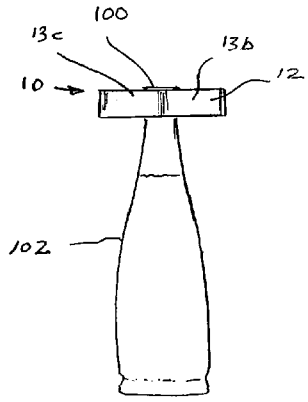
FIG. 15 is a side elevation view of a bottle having a bottle cap.

During use, the bottle cap turning device 10 is placed over the bottle cap 100, as shown in FIG. 15. Once the bottle cap turning device 10 is fitted onto the bottle cap 100, the user can release his or her grip thereon while the bottle cap turning device 10 continues to grip the bottle cap 100 on the bottle 102 unaided. In this manner, the user can then focus on the twisting operation of the bottle cap turning device 10 without continuing to press and/or stabilize the bottle cap turning device 10 on the bottle cap 100 on the bottle 102.

Figure 12:
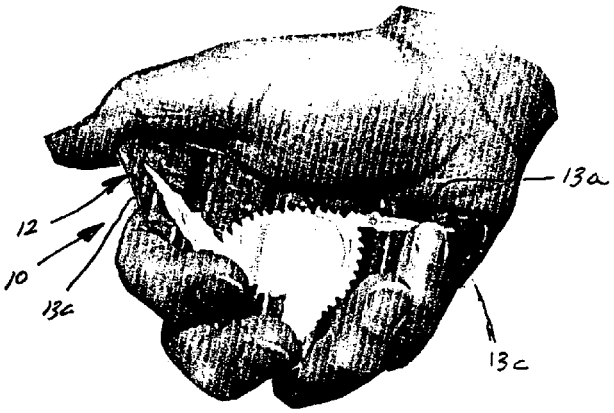
FIG. 12 is a perspective view showing the bottle cap turning device according to the present invention held upside down in the hand of a user.
Figure 13:
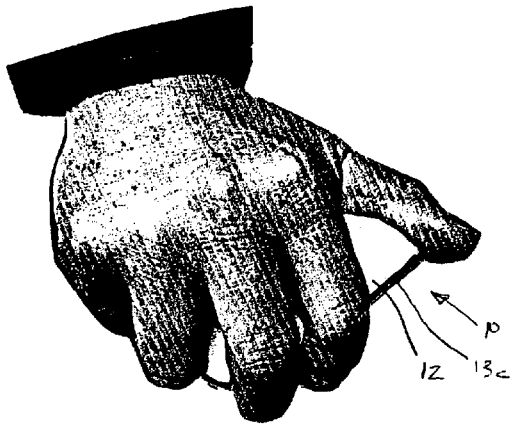
FIG. 13 is a perspective view of the bottle cap turning device according to the present invention held right side up in the hand of a user.
Figure 14:
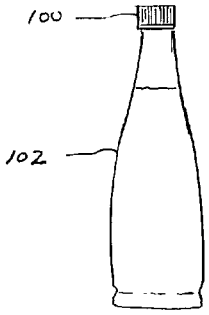
FIG. 14 is a side elevation view of a bottle having a bottle cap.

The user then grips the finger gripping element 12 using his or her fingers in the manner shown in FIGS. 12 and 13. The user then begins to twist the bottle cap turning device 10 in the proper direction for untightening or tightening the bottle cap 100 on the bottle 102 while holding the bottle 102 from rotating with the other hand. The user continues to twist the bottle cap turning device 10 to progressively grip the bottle cap 100 until the bottle cap 100 begins to rotate during an opening operation, or continues to twist the bottle cap turning device 10 until the bottle cap 100 is sufficiently tightened on the bottle 102 during a closing operation.

More specifically, the user places his or her thumb and the thenar eminence and hypothenar eminence, on the longer side 13*a* of the finger-gripping member 12, the index finger and middle finger on one side of the finger gripping member 12 and the $4^{th}$ and $5^{th}$ finger on the other side of the finger gripping member 12 to give a good grip. Also the long side 12*a* of the finger-gripping member 12 with the thumb at the tip of the finger gripping member 12 gives a good torque. The bottle cap receiver of the device having the concave shape and teeth, gradually increase the pressure and cause a tighter grip on the bottle cap as the device as it is twisted. The material of this device can be firm rubber, so the grip of the fingers can apply the pressure easily, and the thickness of the finger-gripping member 12 is about 2 cm. The length of the edges of the finger gripping member 12 is about 2 to 5 cm.

We claim:

1. A bottle cap turning device said device comprising:

a resilient right triangular-shaped finger gripping member having an upper right triangular-shaped side and a matching lower right triangular-shaped side;

a resilient circular-shaped bottle cap receiver provided in a center of said finger gripping member, said bottle cap receiver reducing in diameter to grip an outer surface of the bottle cap upon twisting said finger gripping member while the bottle cap resists turning;

three (3) resilient blade-shaped slots provided in said finger gripping member, said three (3) slots defining three (3) spokes ending and defining said bottle cap receiver, said three (3) slots opening into said bottle cap receiver and extending substantially tangentially outwardly from said circular-shaped bottle cap receiver towards respective corners of said triangular-shaped finger gripping member, said slots being located equidistance around a perimeter of said circular-shaped bottle cap receiver, said blade-shaped slots being wider at their inner bases and tapering downwardly towards their outer ends, two of said slots having an equal length and one of said slots having a shorter length; and three (3) sets of gripping teeth provided on three (3) inner surface portions of said bottle cap receiver and located between adjacent slots, said gripping teeth being aligned parallel and spaced apart to mesh and cooperate with outer ridges provided on an outer surface of a bottle cap to be opened, whereby said gripping teeth initially engage the outer ridges of the bottle cap and then increasingly forcibly grip the bottle cap as said finger gripping member is further twisted by the user until the bottle cap begins to turn or stop turning on the bottle.

2. A bottle cap turning device said device comprising:

a resilient triangular-shaped finger gripping member having an upper triangular-shaped side and a lower triangular-shaped side;

a resilient circular-shaped bottle cap receiver provided in said finger gripping member, said bottle cap receiver reducing in diameter to grip an outer surface of the bottle cap upon exerting a gripping force by fingers of a user on an outer surface of said finger gripping member;

three (3) resilient slots provided in said finger gripping member, said three (3) slots opening into said bottle cap receiver and extending substantially tangentially outwardly from said circular-shaped bottle cap receiver towards respective corners of said triangular-shaped finger gripping member, said slots being located equidistance around a perimeter of said circular-shaped bottle cap receiver; and three (3) sets of bottle cap gripping members provided on three (3) inner surface portions of said bottle cap receiver and located between adjacent slots, said bottle cap gripping members progressively cooperate with an outer surface of the bottle cap as the finger gripping member is twisted while the bottle cap resists turning, whereby said bottle cap gripping members initially engage the outer ridges of the bottle cap and then increasingly engage and forcibly grip the bottle cap as said finger gripping member is further twisted by the user until the bottle cap begins to turn or stop turning on the bottle and said three resilient slots decrease in width as the finger gripping member is twisted while the bottle cap resists turning.

3. A device according to claim 2, wherein said bottle cap receiver opens on both triangular-shaped sides of said finger gripping member, and one side of said device is used to untighten the bottle cap on the bottle and the opposite side of said device is used to tighten the bottle cap on the bottle.

4. A device according to claim 2, wherein a portion of each of said three (3) slots are oriented substantially parallel relative to three (3) sides of said finger gripping member.

5. A device according to claim 2, wherein said three (3) slots are blade-shaped slots.

6. A device according to claim 2, wherein said three (3) slots each have curvilinear sides.

7. A device according to claim 6, wherein outer sides of said three (3) slots are concave-shaped.

8. A device according to claim 6, wherein inner sides of said three (3) slots are convex-shaped.

9. A device according to claim 7, wherein inner sides of said three (3) slots are convex-shaped.

10. A device according to claim 2, wherein said triangular-shaped finger gripping member is a right triangular-shaped finger gripping member.

11. A device according to claim 8, wherein said gripping teeth are spaced apart and oriented parallel with ridges located on the outer surface of the bottle cap to mesh and cooperate therewith during untightening and tightening of the bottle cap on the bottle.

12. A device according to claim 2, wherein said three (3) gripping members are three (3) sets of teeth.

13. A device according to claim 12, wherein said sets of teeth progressively engage and grip the outer ridges on the bottle cap as the finger gripping member is further twisted.

14. A device according to claim 2, wherein said sets of teeth are oriented to progressively engage and grip the outer ridges on the bottle cap as the finger gripping member is further twisted.

15. A device according to claim 14, wherein said sets of teeth are progressively oriented along a curved secant set off angle relative to a curvature of the outer surface of the circular-shaped receiver.

16. A device according to claim 2, wherein two (2) of said slots are longer than the third said slot.

* * * * *